United States Patent [19]

Seiler et al.

[11] Patent Number: 4,586,193

[45] Date of Patent: Apr. 29, 1986

[54] FORMANT-BASED SPEECH SYNTHESIZER

[75] Inventors: Norman C. Seiler, West Melbourne, Fla.; Stephen S. Walker, Lilburn, Ga.

[73] Assignee: Harris Corporation, Melbourne, Fla.

[21] Appl. No.: 447,947

[22] Filed: Dec. 8, 1982

[51] Int. Cl.[4] ..... G10L 1/00

[52] U.S. Cl. ..... 381/51

[58] Field of Search ..... 381/51-53

[56] References Cited

PUBLICATIONS

Flanagan, Speech Analysis Synthesis and Perception, Springer-Verlag, 1972, pp. 42, 340, 342.

B. Gold and L. R. Rabiner, "Analysis of Digital and Analog Formant Synthesizers", *IEEE Trans. Audio and Elect.*, AU-16, (1), pp. 81-94, Mar. 1968.

L. R. Rabiner, "Digital-Formant Synthesizer for Speech Synthesis Studies", J. Acoust. Soc. Am., vol. 43, No. 4, pp. 822-828, 1968.

L. R. Rabiner et al., "A Hardware Realization of a Digital Formant Speech Synthesizer", *IEEE Trans. Comm. Tech.*, vol. COM-19, No. 6, pp. 1016-1020, Dec. 1971.

D. H. Klatt, "Software for a Cascade/Parallel Formant Synthesizer", J. Acoust. Soc. Am., vol. 65, No. 3, pp. 971-995, Mar. 1980.

L. McCready et al., "A Monolithic Formant-Based Speech Synthesizer", *Proc. 1981 Int. Symp. Circuits and Systems*, pp. 986-988.

*Primary Examiner*—E. S. Matt Kemeny

*Attorney, Agent, or Firm*—Barnes & Thornburg

[57] ABSTRACT

A formant-based multi-path speech synthesizer is reconfigurable to use common elements for different types of sounds. A pitch generator or a noise generator is connected to a glottal signal path for vowel or aspirate sound, respectively. The pole and zero filters normally part of the fricative signal path which produces fricative or stop sounds are used in the glottal signal path for nasal sounds. The output of a spectral filter in the glottal signal path bypasses the cascaded formant filters and is connected directly to the glottal path attenuator for voice bar sounds. The output of the first formant filter is rectified and modulates the noise signal in the fricative path and the glottal and fricative signal paths are summed for voiced fricative sounds. To minimize spectral tilt, the third and fourth formant filters and the pole filter are peak filters. The glottal path attenuator is at the end of the glottal signal path to maximize the signal-to-noise ratio.

22 Claims, 10 Drawing Figures

VOWEL GENERATION

ASPIRANT GENERATION

NASAL GENERATION

VOICE-BAR GENERATION

FRICATIVE OR STOP GENERATION

VOICED FRICATIVE GENERATION $$T(s) = \frac{s^2 + \omega_0 s + \omega_0^2}{s^2 + \frac{\omega_0 s}{Q} + \omega_0^2}$$

FORMANT-BASED SPEECH SYNTHESIZER

BACKGROUND OF THE INVENTION

The present invention relates generally to speech synthesizers and, more specifically, to a formant-based speech synthesizer.

The application of digital and analog network synthesis to the generation of artificial speech has been an area of active research interest for over two decades. Methods of implementing speech synthesizers range from digital algorithms in large-scale mainframe-based systems to VLSI components intended for commercial consumption. Analysis and synthesis techniques most commonly used for speech processing rely upon concepts such as LPC (Linear Predictive Coding), PARCOR (Partial Autocorrelation), CVSD (Continuously Variable-Slope Delta Modulation) and waveform compression. Generally, these methods share either or both of two deficiencies: (1) the speech quality is sufficiently coarse or mechanical to become annoying after repeated listening sessions, and (2) the bit rate of the associated encoding scheme is too high to permit memory efficient realization of large vocabulary systems. To date, these limitations have restricted high-volume application of speech synthesizers to the consumer marketplace.

Multiple-path formant-based synthesizers have been developed to overcome the limitations of the other approaches, examples of which are described in:

(1) B. Gold and L. R. Rabiner, "Analysis of digital and analog formant synthesizers", *IEEE Trans. Audio and Elect.*, AU-16 (1), pp. 81–94, Mar. 1968;

(2) L. R. Rabiner, "Digital-formant synthesizer for speech synthesis studies", *J. Acoust. Soc. Am.*, Vol. 43, No. 4, pp. 822–828, 1968;

(3) L. R. Rabiner et al, "A hardware realization of a digital formant speech synthesizer", *IEEE Trans. Comm. Tech.*, Vol. COM-19, No. 6, pp. 1016–1020, Dec. 1971;

(4) D. H. Klatt, "Software for a cascade/parallel formant synthesizer", *J. Acoust. Soc. Am.*, Vol. 65, No. 3, pp. 971–995, March 1980; and (5) L. McCready et al, "A monolithic formant-based speech synthesizer", *Proc.* 1981 *Int. Symp. Circuits and Systems*, pp. 986–988.

The systems described are capable of generating all or substantially all of the seven basic sound classes of human speech, namely, vowels, aspirates, nasals, voice bar, fricatives, stops, voiced fricatives and pauses except for the second Rabiner article.

The earlier multiple-path formant-based synthesizers described by Rabiner and Klatt included a substantial number of elements which made them difficult to implement on a single chip. In these systems in addition to the initial shaping network, the output waveform is further processed by a radiation network. Similarly, the voiced and the fricative signal paths each included their own complete set of sometime duplicate filters. While the synthesizer described by McCready et al reduced the complexity, it also potentially limited the quality of the generated sound. For example, the pole and zero filters were deleted from the voiced signal path and special programming of the first formant filter was required for nasal sounds. The modulation of the noise source by the voice source for voiced fricatives was also deleted.

All of the above formant-based synthesizers use second order lowpass filters for all the formant filters. The response of these filters produces an excess of spectral tilt in the resulting waveform when realized with analog filters. Because of a symmetry about half-sampling frequency, attenuation roll-off is generally much shallower when implemented with digital filters. However, excessive tilt may also be observed in speech spectra produced by digital low pass filters for particular speakers and certain sounds. As described in the Rabiner article, higher pole compensation networks are typically needed for spectral correction in analog synthesizers.

SUMMARY OF THE INVENTION

An object of the present invention is to provide a formant-based synthesizer having the speech quality and characteristics of the earlier formant-based synthesizers yet capable of being economically implemented on a single integrated chip.

Another object of the present invention is to provide a formant-based voice synthesizer which does not produce excessive spectral tilt in the voice signal waveform and which does not require associated higher pole compensation circuitry.

Still another object of the present invention is to reduce the number of filters and attenuators in a formant-based synthesizer without reducing the quality or intelligibility of the resulting artificial speech.

Still an even further object of the present invention is to provide an architecture for a formant-based synthesizer which is capable of operating at low bit rates while providing the speech quality of other synthesizers operating at much higher bit rates.

These and other objects of the invention are attained by a reconfigurable architecture which allows selection and mixing of elements of the glottal and fricative signal generation paths and unique selection and placement of the filters and attenuators. The glottal or voiced signal generation path includes a single spectral filter at the beginning of the path connected in series with four cascaded formant filters and glottal path variable attenuator. The spectral filter is a first order lowpass filter, the first and second formant filters are second order lowpass filters, and the third and fourth formant filters are second order peak filters. The fricative path includes an input signal modulator connected in series with a fricative path variable attenuator and pole and zero filters. The pole filter is a peak filter and the zero filter is a band-rejection filter. A pitch signal generator for glottal or voiced sounds and a noise generator for fricative sounds are provided.

For vowel sounds, the pitch generator is connected to the glottal signal generation path, whereas for aspirate sounds, the noise generator is connected to the glottal signal generation path. For nasal sound generation, the pitch generator is connected to the glottal path and the pole and zero filters are disconnected from the ficative path and connected between the fourth formant filter and the glottal path attenuator. For voice bar generation, the pitch generator is connected to the glottal signal generation path and the output of the spectral filter bypasses the cascaded formant filters and is connected directly to the glottal path attenuator. For unvoiced fricatives and stops, the noise generator is connected to the fricative signal generation path and no modulation is applied to the noise signal. For voiced-fricative sound, the pitch generator is connected to the glottal signal generation path, the noise generator is connected to the fricative path and the output of the first formant filter is rectified and connected to the modulator to modulate the noise signal in the fricative generation path. The frequency of the pitch generator, the frequencies of the formant filters, the frequencies of the zero and pole filters and the amplitude of the glottal path and fricative path attenuators are all programmable on a time varying basis using stored parameter data derived from a frame-oriented speech encoding scheme.

Other objects, advantages and novel features of the present invention will become apparent from the following detailed description of the invention when considered in conjunction with the accompanying drawings.

DESCRIPTION OF THE PREFERRED EMBODIMENTS

Figure 1:
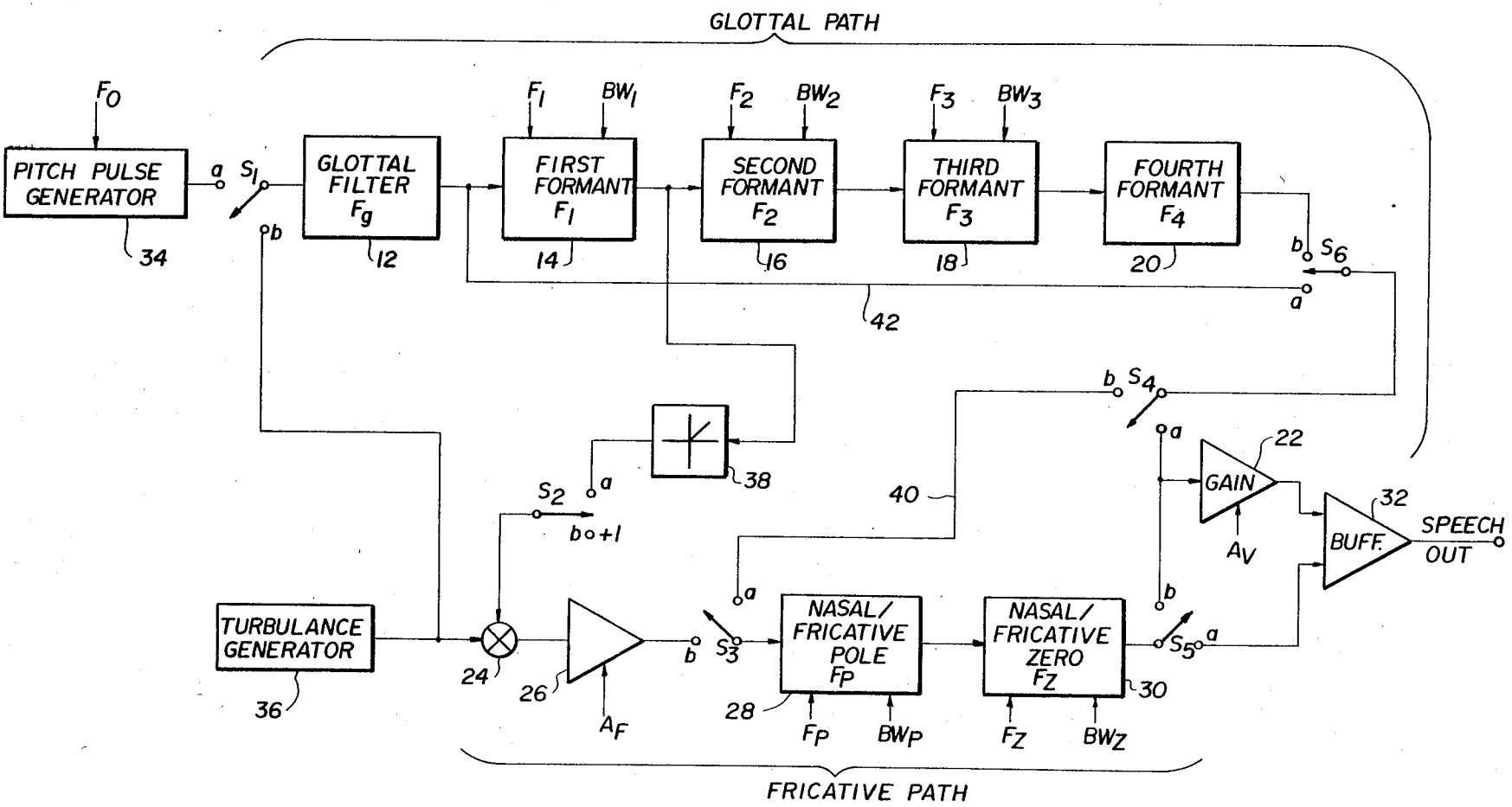
FIG. 1 is a block diagram of the architecture of a vocal tract model incorporating the principles of the present invention.

A diagram of the vocal tract model of a formant-based speech synthesizer is illustrated in FIG. 1. It should be noted that this formant based speech synthesizer is a waveform reconstruction device which generates allophones and diphones as well as the associate phonemes with equal ease. The control parameters are not oriented towards phoneme production only but towards equal ability to produce, phonemes, phoneme boundaries or transitions, as well as interphonemic fluctuations. This is to be distinguished from phoneme synthesizers which generate sound packets or sound parts called phonemes. The phoneme synthesizers reproduce a limited number of phonemes in the English language, usually less than a hundred. Although some phoneme synthesizers use formant filters, they are not true formant synthesizers and are not considered so in the present patent application.

The vocal tract model of the formant-based speech synthesizer architecture, as illustrated in FIG. 1, includes a glottal path in parallel with a fricative path. The glottal path includes a glottal or spectral shaping filter 12; first, second, third and fourth formant filters 14, 16, 18, 20, respectively; and a glottal path variable attenuator 22 all connected in series. The fricative path includes a modulator 24, a fricative variable attenuator 26, a nasal/fricative pole filter 28 and a nasal/fricative zero filter 30. The output of the glottal path and of the fricative path are connected to an output buffer 32 which provides a speech output. A pitch pulse generator 34 provides a periodic signal of a given frequency. A noise generator 36 is a pseudorandom white noise source. A rectifier 38 is connected between the output of the first formant filter 14 in the glottal path and the modulator 24 of the fricative path.

A plurality of switches are provided to reconfigure the synthesizer to produce the different classes of human speech sounds. Switch S1 connected to the input of the glottal path at the glottal filter 12 selects between the pitch pulse generator 34 and noise generator 36. Switch S2 connected to the modulator 24 of the fricative path selects the rectified modulating signal from the first formant filter and rectifier 38 or DC voltage which is shown as +1, indicating no modulation signal. A third switch S3 connects the nasal/fricative pole and zero filters 38 and 30 to the output of the fricative path attenuator 26 so as to form a fricative path or disconnects the nasal/fricative pole and zero filters from the fricative path and connects them to a link 40 which will be part of the glottal path. Switch S4 normally connects the output of the formant filters to the input of the glottal path attenuator 22 and may disconnect the formant filters from the glottal path attenuator 22 and connect it to the nasal/fricative pole and zero filters 28 and 30 via the link 40 and switch S3. Switch S5 normally connects the output of the nasal/fricative zero filter 30 to the output buffer 32 but may also disconnect it from the buffer 32 and connect it to the glottal path attenuator 22. Switch S6 connects switch S4 either to the output of the fourth formant filter 20 or to the bypass link 42 which is connected directly to the output of the glottal filter 12. The position of the switches for the seven sound classes is illustrated in Table 1:

TABLE 1

FORMANT SYNTHESIZER SWITCH ASSIGNMENTS

| | VOWEL | ASPIRATE | NASAL | VOICE BAR | FRICATIVE OR STOP | VOICED FRICATIVE |
|---|---|---|---|---|---|---|
| $S_1$ | a | b | a | a | a | a |
| $S_2$ | b | b | b | b | b | a |
| $S_3$ | a | a | a | a | b | b |
| $S_4$ | a | a | b | a | b | a |
| $S_5$ | a | a | b | a | a | a |
| $S_6$ | b | b | b | a | b | b |

Figure 2:
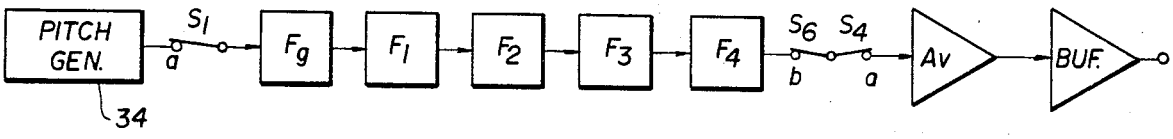
FIG. 2 is a block diagram of the configuration of FIG. 1 for vowel generation.

For the generation of a vowel, switch 1 is in position a, switch $S_6$ is in position b and switch $S_4$ is in position a to connect the buffer 32 and attenuator 22 to the complete glottal path as illustrated in FIG. 2. The switch $S_3$ is in position a, so that the signal from the noise generator 36 is not transmitted through the remainder of the fricative path. Thus, the output buffer 32 only has a single signal from the glottal path.

Figure 3:
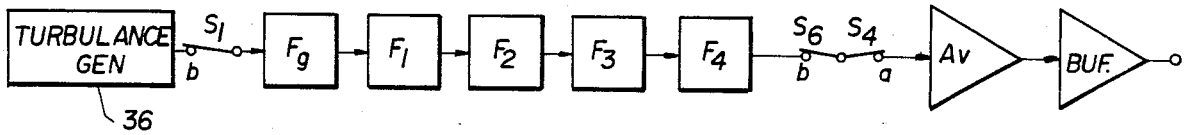
FIG. 3 is a configuration of FIG. 1 for an aspirate generation.

For an aspirate sound generation, illustrated in FIG. 3, the switch $S_1$ is in the b position connecting the noise generator 36 to the complete glottal path wherein switch $S_6$ is in its b position and switch $S_4$ is in its a position. As with the vowel configuration of FIG. 2, switch $S_3$ is in its a position interrupting the fricative path such that the output buffer 32 only has a signal from the glottal path.

Figure 4:
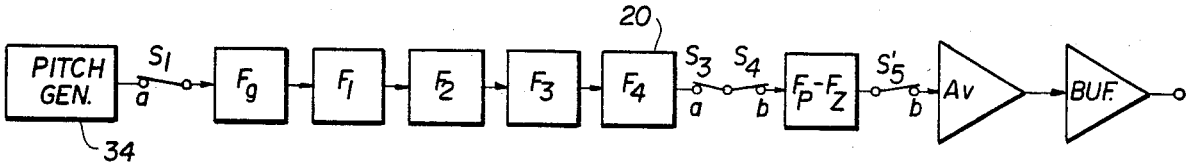
FIG. 4 is a block diagram of the configuration of FIG. 1 for a nasal generation.

For a nasal sound generation, a pole and zero filter must be provided in the glottal path. As illustrated in FIG. 4, switch $S_1$ is in the a position connecting the pitch generator 34 to the glottal path and switch $S_6$ is in its b position, switch $S_4$ in its b position, switch $S_3$ in its a position and switch $S_5$ in its b position which effectively connects the output of the fourth formant filter 20 to the input of nasal/fricative pole and zero filters 28 and 30 and connects the output of the nasal/fricative zero filter 30 to the input of the glottal path attenuator 22. With switch $S_3$ in its a position, the nasal/fricative pole and zero filters 28 and 30 are effectively removed from the fricative path and no fricative signal is provided to the output buffer 32.

Figure 5:
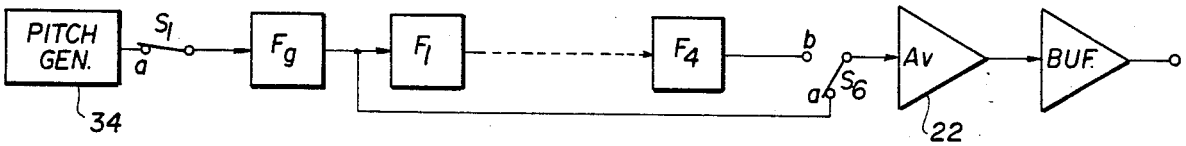
FIG. 5 is a block diagram of a configuration of FIG. 1 for a voice bar generation.

For voice bar signal generation, as illustrated in FIG. 5, switch $S_1$ is its a position connecting pitch generator 34 to the glottal path and switch $S_6$ is in its a position bypassing the formant filters 14, 16, 18 and 20 by bypass link 42 and connecting the glottal filter 12 directly to the glottal path attenuator 22 via switch $S_4$ in its a position. Switch $S_3$ is in the a position to interrupt the fricative path such that the output buffer 32 only has a single input from the glottal path.

Figure 6:
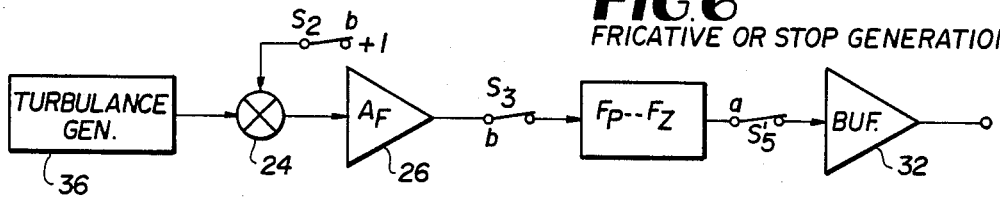
FIG. 6 is a block diagram of a configuration of FIG. 1 for a fricative or stop generation.

To generate a fricative or stop sound, as illustrated in FIG. 6, switch $S_2$ is connected in its b position to the fixed voltage +1 such that there is no modulation of the noise generator 36 as inputted to the fricative path attenuator 26. Switch $S_3$ is in its b position and switch $S_5$ is in its a position such that the fricative path is complete providing an output to the output buffer 32. Switch $S_4$ is in the b position to interrupt the glottal path.

Figure 7:
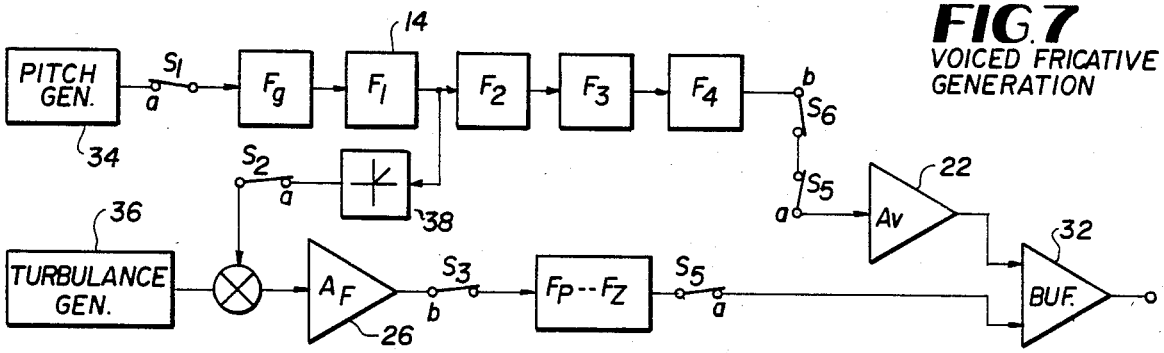
FIG. 7 is a block diagram of the configuration of FIG. 1 for a voiced fricative generation.

For a voiced fricative generator, as illustrated in FIG. 7, the glottal and fricative paths are both used simultaneously. Switch $S_1$ is in its a position connecting the pitch generator 34 to the glottal path and switch $S_6$ in its b position and $S_4$ in its a position connecting the output of the formant filters to the glottal path attenuator 22 which provides one input to the output buffer 32. Switch $S_2$ is in its a position connecting the output of the first formant filter 14 through half-wave rectifier circuit 38 to the modulator 24 to pulse modulate the output of the noise generator 36 as an input to the fricative path attenuator 26. Switch $S_3$ is in its b position and switch $S_5$ is in its a position to complete the connection of the fricative path and provide a second input to the output buffer 32. Thus, voiced fricative generation is a result of noise and pitch generated signals provided through their appropriate paths with a modulation of the noise signal by a portion of the voice signal.

An analysis of FIG. 1, in view of the multiple configurations of FIGS. 2–7, will reveal that the present architecture is truly versatile. Similarly, the number of elements used compared to prior art devices are substantially reduced.

The multiple use of the pole and zero filters 28 and 30 for both the generation of the nasal generation, as illustrated in FIG. 4, and for fricative generation, as illustrated in FIGS. 6 and 7, by the use of switches $S_3$, $S_4$ and $S_5$ eliminate redundancy of prior architectures. Prior art either uses separate filter pairs to generate these sounds, eliminates the zero filter or use more complex parallel-synthesis techniques.

For voiced fricative generation, extra filters and variable gain amplifiers are eliminated. By connecting the glottal path to the modulator 24 of the fricative path by using the output of the first formant filter 14 and only a rectifier 38 and a switch $S_2$, the additional filters and gain amplifiers of prior art in the connecting path have been eliminated.

Another improvement of the present system over a majority of the prior art devices is to use a single spectral shaping glottal filter 12 at the input of the glottal path to the formant filters 14–20. This shaping filter represents the spectral coloring effects of various points in the human vocal tract and at the mouth. This replaces the shaping filter and output radiation load filter of prior art systems. Applicant has found that the effects of the multiple filters of the prior art cancel each other and, thus, a single spectral filter can be used. The glottal filter 12 is preferably a fixed value first order lowpass filter.

The multiple use of the same pole and zero filters for the nasal and fricative generation, the elimination of extra filters and variable gain amplifiers for the voiced fricative generation and the elimination of redundancy in spectral shaping source filters and radiation filters results in a speech synthesizer implementation that is efficient both in integrated circuit form, by less silicon area or die size, and on a digital computer by being implemented in less complicated algorithms. These redundancies are eliminated without sacrificing speech quality. Thus, the invention lies within the architectural concept regardless of how the system is implemented. Either analog, digital or sample-data filter schemes may be used in discrete or integrated circuit realization and reduction in circuitry complexities and improvement in speech quality will still result with the present architecture compared to formant-based concepts of the prior art. Similarly, reduction in algorithm complexity or execution time are observed in digital computer implementation regardless of whether the filters of FIG. 1 are modelled by conventional two pole Z-domain digital filters or by digital approximations to analog functions.

Another feature of the present invention is the placement of the glottal path attenuator 22 at the end of the glottal signal generation path. Most speech synthesizer architects of the prior art neglected the importance of maximizing the signal-to-noise ratio by careful placement of the amplitude attenuator functions for the glottal and fricative paths. Such attenuators are necessary to permit dynamic adjustment of the output signal and it is desirable to place the attenuators as close to the end of the signal path as possible so that both noise and signals may be attenuated. Placing gain controls towards the energy sources reduces the effect on noise levels and degrades the signal-to-noise ratio. Due to the switching constraints of the present architecture to provide all the desired combinations of reconfiguration, it is not possible to place both the glottal path attenuator and the fricative path attenuator near the outputs or ends of their signal paths. Thus, the glottal attenuator 22 is placed at the end of the glottal signal generation path since the voice sounds are more sensitive to signal-to-noise ratio.

Still another improvement of the present invention is the use of peak filters for the third and fourth formant filters 18 and 20 and for the nasal-fricative pole filter 28. Essentially all present speech synthesizer architects assume or specify that filter blocks for the formant and the nasal pole will be implemented using second-order complex-conjugate lowpass filters in either the analog or digital form. In analog form, the filter transfer function is expressed by a second-order lowpass quadratic in S and generally has a 12 dB per octave tail. A review of the literature cited in the Background of the Invention show examples of this transfer function. This roll-off effect produces excess spectral tilt in formant synthesizers realized with analog filters. Because of the symmetry about the half-sampling frequency, attenuation roll-off is generally shallower in digital low-pass filters than in analog filters of the same order. However, excess tilt may also be observed occasionally in speech spectra produced by digital filters with particular speakers and certain sounds.

Figure 8:
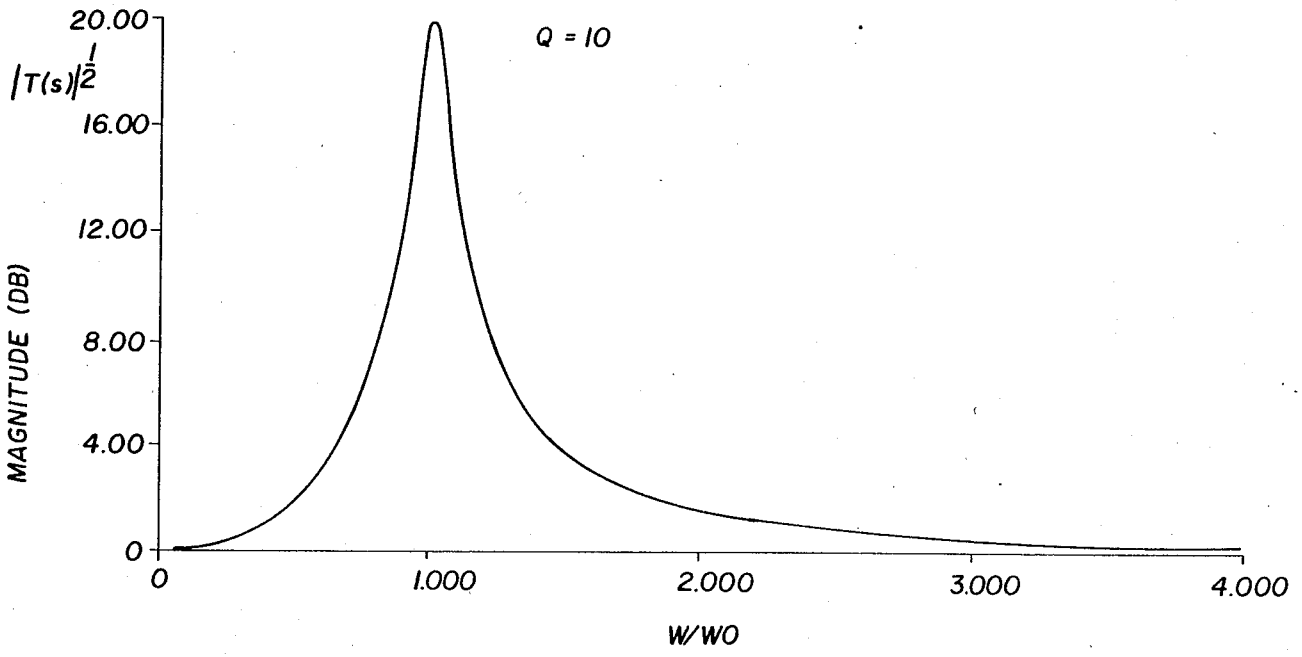
FIG. 8 is a graph of the normalized response and transfer function of a peak filter.

The present architecture corrects this effect by using peak filters for the nasal pole filter 28 and the third and fourth formant filters 18 and 20. The peak filter is a second order bandpass filter response summed with a unity gain function. The result is a modified all-pass network with a resonant peak. The analog transfer function and the frequency response of the peak filter are illustrated in FIG. 8. The peak filter's response is flat both above and below resonance in contrast to the 12 dB's per octave tail-off of the second order lowpass filters. Thus, the total cascaded response characterstic rolls off less sharply at high frequencies than the classical lowpass filter architecture for the glottal path. This results in the improved match in spectral tilt between original synthetic speech without the need of higher pole compensation networks or radiation load filters. This is of particular significance in monolithic sampled-data (switched-capacitor) implementation. Also, the present architecture need not be tailored to voices having a limited range of spectral characteristics in order to achieve optimum quality speech.

The first and second formant filters 12 and 14 are second order lowpass filters and the nasal-fricative zero filter is a band rejection filter.

The pitch pulse generator may be one of several well-known generators including unipolar pulse, bipolar pulse, Hilbert pulse, Bessel pulse, Wong pulse or other periodic energy sources. Also, the turbulence generator 36 may be any type of noise or pseudorandom signal generator which is easily integrated onto a silicon chip.

The sixteen operational parameters required by the synthesizer architecture of FIG. 1 to generate speech and suggested nominal ranges for most male speakers are described in Table 2. The respective points of input are noted in FIG. 1.

TABLE 2

FORMANT SYNTHESIZER PARAMETERS

| Parameter | Description | Bits | Range |
|---|---|---|---|
| $F_0$ | * Pitch frequency | 5 | 0,65–160 Hz |
| $F_g$ | Glottal filter break frequency | fixed | 200 Hz |
| $F_1$ | * Center frequency of first formant | 4 | 200–800 Hz |
| $BW_1$ | Bandwidth of first formant | 4($F_1$ dependent) | 50–80 Hz |
| $F_2$ | * Center frequency of second formant | 4 | 800–2100 Hz |
| $BW_2$ | Bandwidth of second formant | 4($F_2$ dependent) | 50–200 Hz |
| $F_3$ | * Center frequency of third formant | 3 | 1500–2900 Hz |
| $BW_3$ | Bandwidth of third formant | 3($F_2$ dependent) | 130–200 Hz |
| $F_4$ | Center frequency of fourth formant | fixed | 3200 Hz |
| $BW_4$ | Bandwidth of fourth formant | fixed | 200 Hz |
| $F_Z$ | * Center frequency of nasal/fricative zero | 3 | 600–2000 Hz |
| $BW_Z$ | Bandwidth of nasal/fricative zero | 3($F_z$ dependent) | 100–300 Hz |
| $F_P$ | Center frequency of nasal/fricative pole | 3($F_z$ dependent) | 200 Hz (nasal), 1400–4000 Hz |
| $BW_P$ | Bandwidth of nasal/fricative pole | 3($F_z$ dependent) | 40 Hz (nasal), 320–800 Hz |
| $A_V$ | * Voicing amplitude | 3, (6 dB steps) | 0,0.016–1.0 |
| $A_F$ | * Fricative amplitude | 3, (6dB steps) | 0,0.016–1.0 |

Some method of generating, encoding and storing the speech data for the above parameters prior to synthesis is necessary. Acceptable parameter generation techniques include computer-aided analysis of human speech, visual analysis of speech spectra or sonograph plots, artificial parameter generation by rule, and conversion from analysis data assembled by other methods such as linear predictive coding.

All thirteen variable parameters may be independently controlled for maximum speech quality or certain parameters may be chosen to be dependent variables. The number of independent parameters and the number of quantization levels within each parameter range directly affect the synthesizer's input data rate. By assigning the variables denoted by an asterisk in Table 2 to be independently controlled while allowing the remainder to be dependent functions, it is possible to synthesize high-quality speech at moderate bit rates.

The quantization levels specified in Table 2 result in average bit rates of 500 to 600 bits per second for English vocabularies encoded using the coding scheme to be described in copending application titled "Memory Efficient Speech Data Encoding Scheme". Despite the low average bit rate, speech quality is comparable to that produced by higher bit rate waveform compression, and is better than that of a bit rate of 1,200 bits per second using a linear predictive coding method.

Although a specific coding scheme is described in the copending application, it should be noted that the present system can be used with any coding scheme compatible with the parameter format of Table 2. The resulting bit rate is primarily a function of the coding scheme itself, and the synthesizer architecture can accept data rates from 200 to 2000 bps or more, with quality directly proportional to bit rate.

Figure 9:
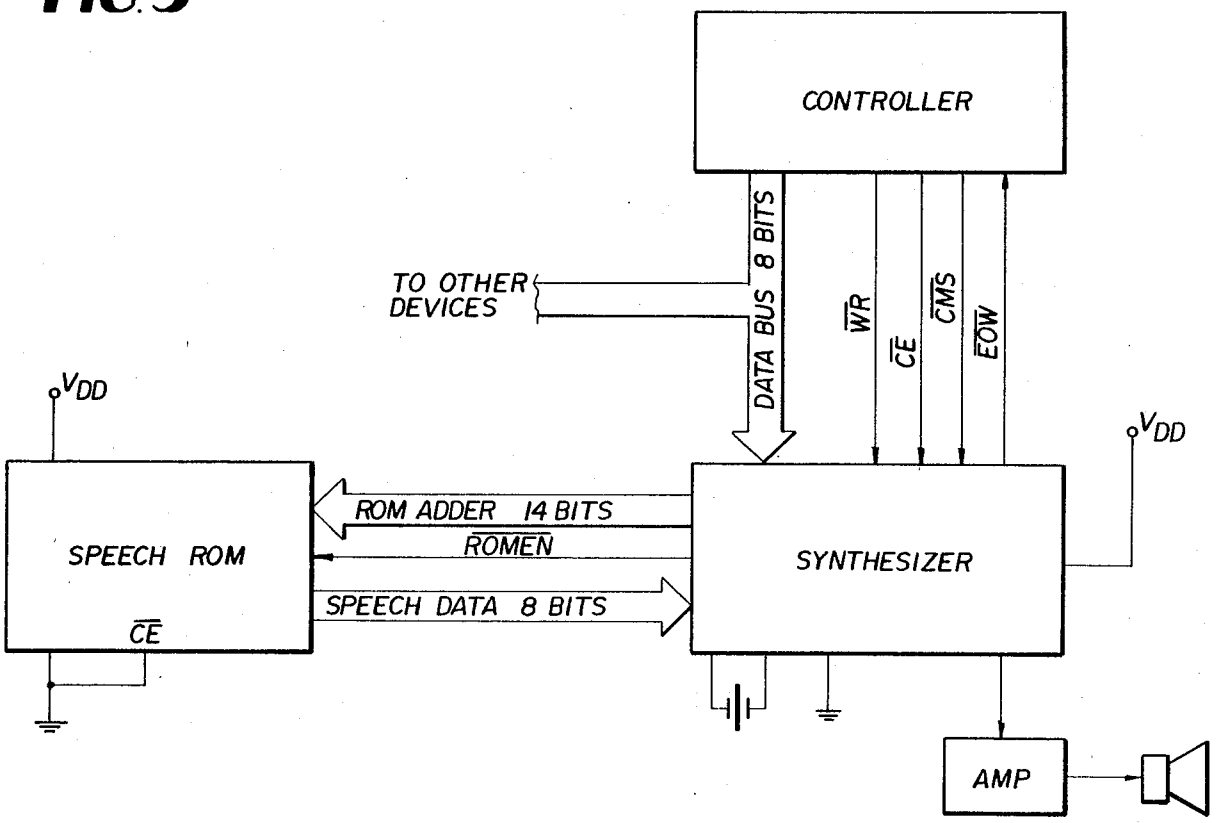
FIG. 9 is a block diagram of the interconnection of the formant synthesizer, speech ROM and micro-controller.
Figure 10:
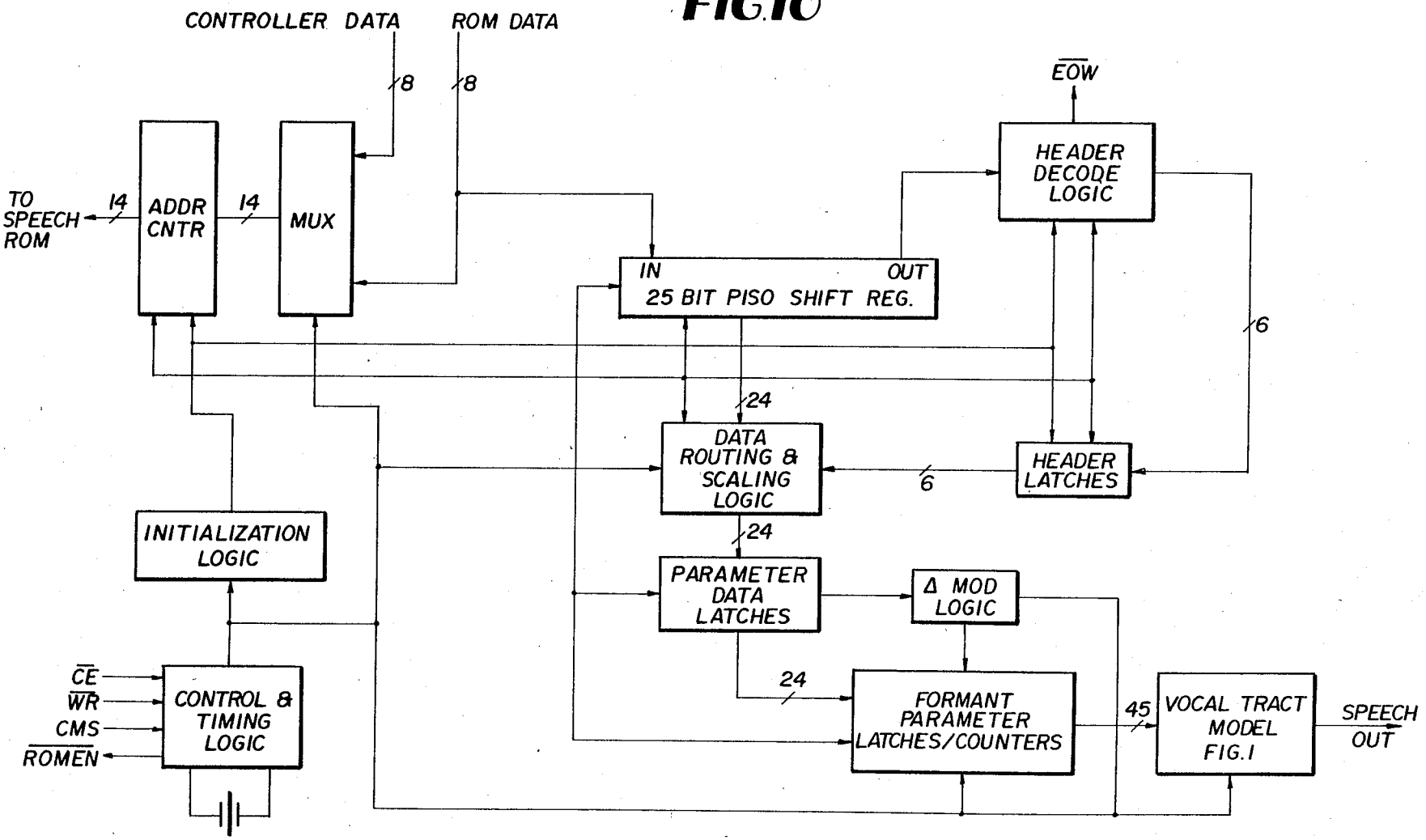
FIG. 10 is a block diagram of the speech synthesizer architecture incorporating the vocal tract model of FIG. 1 of the present invention.

An overall system configuration showing the interconnection of the address, data, and handshaking lines between the synthesizer, speech ROM, and controller is illustrated in FIG. 9. A suggested embodiment for the synthesizer of FIG. 9 which includes the local tract model of FIG. 1 is illustrated in FIG. 10. Since the present invention is considered the vocal track model of FIG. 1, FIGS. 9 and 10 will not be described in detail and the specific blocks are well-known.

FIG. 9 details a monolithic, integrated circuit approach to synthesis, but functionally identical systems may be realized via other methods such as discrete circuitry or digital computer software packages. The speech generation system consists of four principle parts: (1) a controller function which determines when speech will be generated and what will be spoken; (2) a synthesizer block which functions as an artificial human vocal tract or waveform generator to produce the speech; (3) a data bank or memory containing the speech (vocal tract) parameter values required by the synthesizer to generate the various words and sounds which constitute its vocabulary; (4) an audio amplifier, filter and loudspeaker to convert the electrical signal to an acoustic waveform.

As illustrated in FIG. 9, fourteen ROM address lines are supplied, allowing access to 131K bit memories. At 500 bps, this corresponds to 26 seconds of speech. This capacity will be adequate for nearly all possible applications. Data buses for the ROM and controller are separated to avoid bus contentions and a total of five handshake lines are required.

The controller sends an eight bit indirect utterance address to the synthesizer which in turn uses this information to access the two byte start-of-utterance address located in the lowest page of the speech ROM. The controller's data is flagged valid with $\overline{WR}$. The utterance address is output on the ROM address bus lines and the speech data is accessed by byte until an "end of word" ($\overline{EOW}$) code is encountered. Such a code results in determination of the speech generation and the transmission of an interrupt code to the controller via the $\overline{EOW}$ line. The $\overline{ROMEN}$ line is available for memory clocking, where necessary, and the CMS line resets the synthesizer for the next word. An external power amplifier will be required to drive an 8 ohm speaker.

A functional diagram of the synthesizer architecture including the voice tract model of FIG. 1 is illustrated in FIG. 10. The multiplexer and fourteen bit address counter hold ROM access while the twenty-five bit PISO counter buffer converts the eight bit parallel speech data into a serial bit stream for decoding and distribution. The header code logic and latches identify the type of sounds (vocal, nasal, etc.) to be generated and route the incoming data into the appropriate parameter latches for comparison with the previously transmitted data. The new data is blended with the old data via delta modulation and the resulting format parameters are applied to the vocal tract circuitry of FIG. 1.

From the preceding description of the preferred embodiment, it is evident that the objects of the invention are attained and although the invention has been described and illustrated in detail, it is to be clearly understood that the same is by way of illustration and example only and is not to be taken by way of limitation. The spirit and scope of the invention are to be limited only by the terms of the appended claims.

What is claimed is:

1. A formant-based speech synthesizer comprising:

glottal signal path including, in series, glottal filter means for shaping glottal signal path input signals, at least a first, second and third formant filter means for augmenting individual formant frequencies, and glottal path attenuating means for providing a variably attenuated glottal output signal;

fricative signal path including, in series, modulating means for modulating fricative signal path input signals, fricative path attenuating means for variably attenuating fricative signal path signals and a PZ filter means for augmenting pole and zero frequencies;

pitch means for generating a glottal source signal;

pseudorandom noise means for generating a fricative source signal;

first switch means for selectively connecting said pitch means or said noise means to said glottal signal path as an input signal;

second switch means for selectively disconnecting said PZ filter means from said fricative signal path and connecting said PZ filter means between said formant filter means and said glottal path attenuating means;

third switch means for selectively disconnecting said formant filter means from said glottal signal path and connecting said glottal filter means to said glottal path attenuating means;

rectifier means connected to the output of said first fromant filter means for half-wave rectifying the filtered first formant signal;

fourth switch means for selectively connecting said rectifier means or a fixed amplitude signal to said modulating means; and output means for selectively providing an output signal from said glottal signal path, said fricative signal path or from both signal paths in combination.

2. A formant-based speech synthesizer according to claim 1, wherein said first and second formant filter means are second order lowpass filters and the remaining formant filter means are second order peak filters.

3. A formant-based speech synthesizer according to claim 2, wherein said PZ filter means includes a second order peak filter for the pole and a band rejection filter for the zero.

4. A formant-based speech synthesizer according to claim 3, including a fourth formant peak filter in series with the other formant filters.

5. A formant-based speech synthesizer according to claim 1, wherein the center frequency of said first, second and third formant filter means, center frequency of the zero of said PZ filter means, and the frequency of said glottal source signal are independently adjustable.

6. A formant-based speech synthesizer according to claim 5, wherein the attenuation of said glottal and fricative path attenuating means are adjustable.

7. In a formant-based speech synthesizer having a glottal signal generation path and a fricative signal generation path, the improvement being said glottal signal generation path which comprises in series:

glottal source means for providing a glottal source signal;

glottal filter means for spectral shaping said glottal source signal;

first formant second order lowpass filter;

second formant second order lowpass filter;

third formant second order peak filter;

a fourth formant second order peak filter; and glottal path attenuating means for providing an attenuated glottal output signal.

8. A formant-based speech synthesizer according to claim 7, wherein said glottal source means includes pitch means for providing a periodic signal at a selected frequency, fricative means for providing a randomly varying noise signal and means for providing a signal from either said pitch means or said fricative means to said glottal filter.

9. A formant-based speech synthesizer according to claim 7, including means for bypassing said formant filters and connecting said glottal filter means directly to said glottal path attenuating means.

10. A formant-based speech synthesizer according to claim 7, wherein said glottal filter means is a first order lowpass filter.

11. A formant-based speech synthesizer according to claim 7, wherein said fricative signal generation path includes in series:

fricative source means for providing a fricative source signal;

fricative path attenuating means for attenuating fricative signal path signals;

second order peak filter; and band rejection zero filter.

12. A formant-based speech synthesizer according to claim 11, including means for disconnecting said pole and zero filters from said fricative signal generation path and connecting them between said fourth formant filter and said glottal path attenuating means.

13. A formant-based speech synthesizer according to claim 11, including a modulator means between said fricative source means and said fricative path attenuating means and means connecting the output of said first formant filter and said modulating means for modulating said fricative source signal with the output signal of said first formant filter.

14. A formant-based speech synthesizer reconfigurable to produce vowels, aspirates, nasals, voice bar, fricatives, stops and voiced fricative sounds comprising:

glottal signal path including, in-series, glottal filter means for shaping glottal signal path input signals, at least a first, second and third formant filter means for augmenting individual formant frequencies, and glottal path attenuating means for providing an attenuated glottal output signal;

fricative signal path including, in series, modulating means for modulating fricative signal path input signals, fricative path attenuating means for attenuating fricative signal path signals and a PZ filter means for augmenting pole and zero frequencies;

pitch means for generating a glottal source signal;

pseudorandom noise means for generating a fricative source signal;

configuration control means for (a) connecting said pitch means to said glottal signal path to produce vowel sounds, (b) connecting said noise means to said glottal signal path to produce aspirate sounds, (c) disconnecting said PZ filter means from said fricative signal path and connecting said PZ filter means between said formant filter means and said glottal path attenuating means to produce nasal sounds, (d) connecting said glottal filter means directly to said glottal path attenuating means bypassing said formant filter means to produce voice bar sounds, (e) connecting said noise means to said modulator means and a fixed amplitude signal to said modulator means for fricative and stop sounds, and (f) connecting said pitch means to said glottal signal path, said noise means to said fricative path, a portion of the output of said first formant filter means to said modulator means and summing the output of said glottal and fricative signal paths to produce voiced fricative sounds.

15. A formant-based speech synthesizer according to claim 14, wherein said first and second formant filter means are second order lowpass filters and the remaining formant filter means are second order peak filters.

16. A formant-based speech synthesizer according to claim 14, wherein said PZ filter means includes a second order peak filter for the pole and a band rejection filter for the zero.

17. A formant-based speech synthesizer according to claim 15, including a fourth formant peak filter in series with the other formant filters.

18. A formant-based speech synthesizer according to claim 14, wherein the center frequency of said first, second and third formant filter means, center frequency of the zero of said PZ filter means, and the frequency of said glottal source signal are independently adjustable.

19. A formant-based speech synthesizer according to claim 14, wherein the attenuation of said glottal and fricative path attenuating means is adjustable.

20. A formant-based speech synthesizer comprising:

glottal signal path including, in series, glottal filter means for shaping glottal signal path input signals, at least a first, second and third formant filter means for augmenting individual formant frequencies, and glottal path attenuating means for providing a variably attenuated glottal output signal;

fricative signal path including, in series, fricative path attenuating means for variably attenuating fricative signal path signals and a PZ filter means for augmenting pole and zero frequencies;

pitch means for generating a glottal source signal;

pseudorandom noise means for generating a fricative source signal;

first switch means for selectively connecting said pitch means or said noise means to said glottal signal path as an input signal;

second switch means for selectively disconnecting said PZ filter means from said fricative signal path and connecting said PZ filter means between said formant filter means and said glottal path attenuating means; and output means for selectively providing an output signal from said glottal signal path, said fricative signal path or from both signal paths in combination.

21. A formant-based speech synthesizer according to claim 20, wherein said first and second formant filter means are second order lowpass filters and the remaining formant filter means are second order peak filters.

22. A formant-based speech synthesizer according to claim 21, wherein said PZ filter means includes a second order peak filter for the pole and a band rejection filter for the zero.

* * * * *